United States Patent [19]

Ekman et al.

[11] Patent Number: 4,764,962

[45] Date of Patent: Aug. 16, 1988

[54] STEREO SPEAKER SYSTEM FOR WALKMAN-TYPE RADIO AND/OR CASSETTE PLAYER

[76] Inventors: Joseph A. Ekman, 959 Sladky Ave., Mountain View, Calif. 94040; Ronald C. Ball, 125 Northridge La., Woodside, Calif. 94062

[21] Appl. No.: 11,451

[22] Filed: Feb. 8, 1987

Related U.S. Application Data

[63] Continuation of Ser. No. 685,827, Dec. 24, 1984, abandoned.

[51] Int. Cl.[4] ..... H04R 5/02

[52] U.S. Cl. ..... 381/24; 381/25; 224/901; 224/209; 224/259

[58] Field of Search ..... 2/300; 224/260, 261, 224/265, 209, 251, 901; 381/24, 25, 1, 74

[56] References Cited

U.S. PATENT DOCUMENTS

| | | | |
|---|---|---|---|
| 1,335,927 | 4/1920 | Ainsworth | 2/300 |
| 2,643,803 | 6/1953 | Bates | 224/260 |
| 2,760,699 | 8/1956 | Rivers-MacPherson | 224/265 |
| 4,070,553 | 1/1978 | Hass | 179/157 |
| 4,322,585 | 3/1982 | Liautaud | 179/157 |
| 4,485,276 | 11/1984 | Sato | 179/157 |
| 4,589,134 | 5/1986 | Waldron | 381/24 |

*Primary Examiner*—Forester W. Isen

*Attorney, Agent, or Firm*—Townsend and Townsend

[57] ABSTRACT

A pair of stereo speakers mounted on an article of clothing worn on the upper part of the body and positioned on the shoulder portion thereof. The clothing article has a pouch for supporting a Walkman-type radio, and the speakers are coupled by cables to the radio in the normal fashion. A quick release attachment device is provided to releasably couple each speaker to the clothing article. For purposes of illustration, the clothing article comprises a pair of suspenders comprised of a pair of straps which are adapted to extend over the shoulder. Each strap has a first Velcro part secured thereto and each speaker has a second Velcro part attached to the rear face thereof, the Velcro parts being removably coupled together to interconnect each speaker and the respective strap. The pouch for the radio can be mounted on the clothing article either at the front of the wearer or on the back of the wearer. In the alternative, the pouch can be removed from the clothing article and placed on a belt at the waist of the wearer.

1 Claim, 1 Drawing Sheet

STEREO SPEAKER SYSTEM FOR WALKMAN-TYPE RADIO AND/OR CASSETTE PLAYER

This is a continuation of application Ser. No. 685,827, filed 12/24/84, now abandoned.

This invention relates to improvements in the mounting of stereo speakers for stereo equipment and, more particularly, to a stereo speaker system for use with a Walkman-type radio and/or cassette player.

BACKGROUND OF THE INVENTION

As is well known, a Walkman-type radio and/or cassette player (hereinafter referred to as radio) uses stereo earphones as speakers to convey the sounds from the radio to the ears. When the radio is so used, it is mounted typically on a belt at the waist of the user or, in the alternative, the radio is held in the hand or in a garment pocket as the user moves about, sits or reclines. Even joggers carry radios of this type with earphones mounted in place as they run.

While stereo earphones are satisfactory for playback of stereo sounds from a radio of the above type, it is desirable at times to have the ears free of such earphones yet still be able to hear the stereo sounds from the radio. For instance, it may be desirable to be able to hear other sounds or be able to increase the volume of the sounds while listening to stereo sounds from a Walkman-type radio. Thus, a need exists for improvements in a stereo speaker system for a Walkman-type radio which can be carried on the person as the person moves about or is sitting or reclining. The present invention satisfies this need.

SUMMARY OF THE INVENTION

The present invention is directed to a stereo speaker system for a Walkman-type radio wherein the system includes a pair of stereo speakers which are mounted on an article of clothing to be worn on a person, with the speakers being located to direct stereo sounds to the ears of the user without interfering with arm and other body movements. Preferably, the speakers are removably mounted on the article of clothing so that, when not in use on the clothing article, they can be placed on a support surface, such as a table, along with the radio when it is desired to hear stereo sounds with the speakers separated from the body of the user.

The clothing article can, for example, be a vest, jacket or pair of suspenders. The clothing article has shoulder portions and means on the shoulder portions for removably mounting the speakers thereon. Thus, the speakers will be in position to direct stereo sounds upwardly and into the vicinity of the ears of the user. Velcro material is especially suitable for removably attaching the speakers to the clothing article.

The radio to be coupled to the speakers can be carried in a pouch in a suitable location on the clothing article. If suspenders are used as the clothing article, the suspenders will generally include a pair of straps which cross each other at some location. The pouch can be provided with loops for receiving the straps at the crossover location of the straps. The pouch can also have other loops which allow the pouch to be placed on a belt at the waist of the user.

When the pouch is carried at the crossover point of the straps, the pouch can be worn at the front of the user or at the back of the user, whichever is desired. In either case, the suspenders are used in the normal fashion to support a garment, such as a pair of trousers, by the use of attachment devices at the lower ends of the straps of the suspenders.

The primary object of the present invention is to provide an improved stereo speaker system for a Walkman-type radio and/or cassette player, wherein the speaker system includes a pair of stereo speakers which are coupled to an article of clothing worn on the upper body of the user of the system with the speakers being near the shoulder portions of the clothing article to direct stereo sounds upwardly from the shoulder portion and into the vicinity of the user's ears, to thereby allow the user to move about, sit or recline, all of which can be done while listening to the stereo sounds from the speakers.

Other objects of this invention will become apparent as the following specification progresses, reference being had to the accompanying drawings for an illustration of the invention.

IN THE DRAWING

Figure 1:
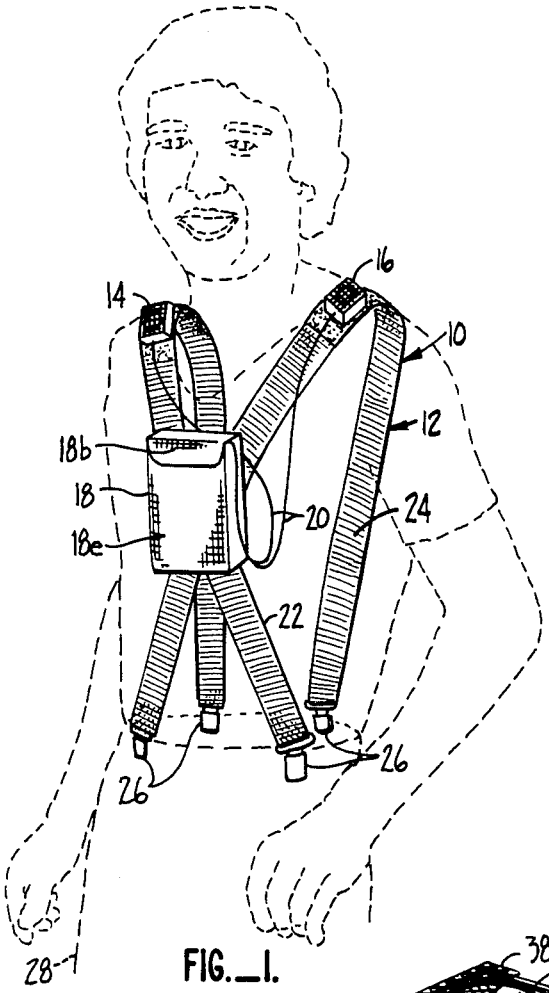
FIG. 1 is a perspective view of the aerial speaker system of the present invention, showing the way in which an article of clothing in the form of a pair of suspenders is used with the stereo speakers coupled to a Walkman-type radio.

The speaker system of the present invention is broadly denoted by the numeral 10 and includes an article of clothing 12, a pair of stereo speakers 14 and 16 and a pouch 18 for holding a Walkman-type radio which can be coupled by electrical leads or cables 20 to stereo speakers 14 and 16. For purposes of illustration, the article of clothing 12 comprises a pair of suspenders formed in a conventional manner and defining a pair of straps 22 and 24. The straps have opposed ends provided with fastener devices 26 which can quickly and easily be coupled to another garment worn by a person, such as a pair of trousers 28, as shown in FIGS. 1 and 2.

Figure 2:
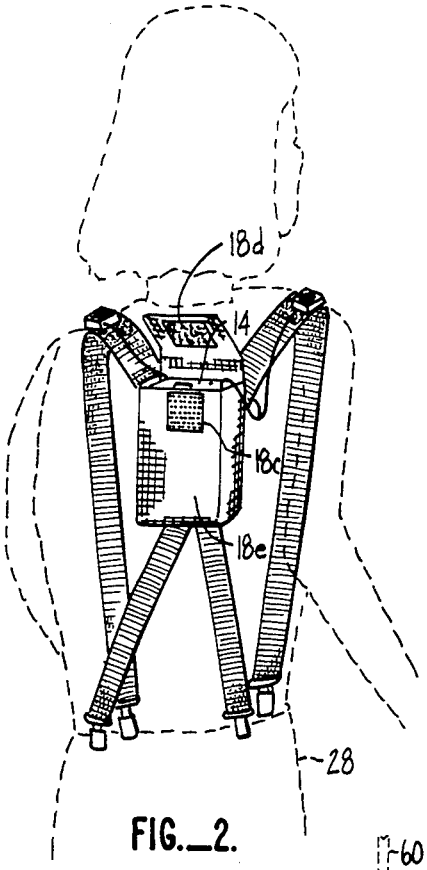
FIG. 2 is a view similar to FIG. 1 but showing another way in which the suspenders are used to mount the radio in back instead of in the front as shown in FIG. 1.
Figure 3:
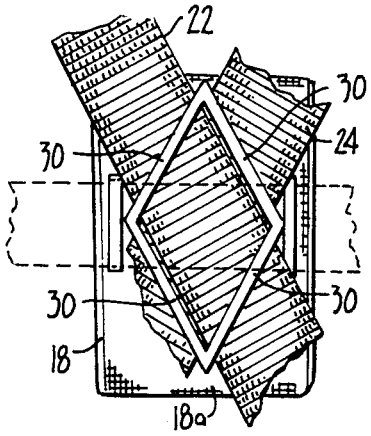
FIG. 3 is an enlarged, fragmentary, elevational view of the system of the present invention, showing the way in which the pouch for the radio is removably coupled to the straps of the suspenders.
Figure 5:
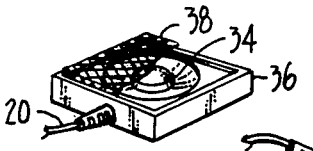
FIG. 5 is a perspective view, partly broken away, of one of the stereo speakers of the system of the present invention.

Straps 22 and 24 cross each other in the manner shown in FIG. 3, and this crossover location of the two straps can be placed at the front of the person as shown in FIG. 1 or at the rear of the person as shown in FIG. 2. In either position of the crossover point of the straps, the suspenders will still operate to support garment 28 as well as to support and to be coupled with pouch 18. Generally, the straps 22 and 24 at the crossover point are not connected together. This allows the straps to be placed within loops defined by a number of strips 30 which are secured, such as by stitching, at the ends thereof to the back panel 18*a* of pouch 18. Strips 30 form a diamond-shaped configuration as shown in FIG. 3 and the height of the pouch is effectively determined generally by the frictional engagement between straps 22 and 24 and adjacent strips 30. This height can be slightly adjusted, if desired, to render the placement of the radio in pouch 18 comfortable to the user of system 10.

Straps 22 and 24 can be of any suitable material. Typically, they are of a fabric material which can be stitched. The width of the straps can be of any suitable size. For example, the width can be 1.5 inches.

Pouch 18 can be of any suitable material as well. Typically, it is of a fabric material to decrease weight while providing strength to the pouch. The pouch is of a size to receive and contain a Walkman-type radio. Preferably, the pouch has a cover or top 18*b* which is hingedly mounted to the rear panel 18*a* of the pouch and releasably secured by Velcro pads 18*c* and 18*d* to the front panel 18*e* of the pouch. The open upper end of the pouch allows the leads or cables 20 to be coupled to the radio 34 in the pouch as shown in FIG. 2.

Speakers 14 and 16 are conventional in construction and are generally identical to each other. Each speaker is in a housing 36 which, for purposes of illustration, is square in configuration. It has a cable 20 coupled to and extending outwardly from the housing and electrically coupled to the speaker mechanism itself. Each speaker has a mesh cover 38 to protect the cone 39 from being touched by the fingers of the hand yet the mesh cover allows the stereo sounds to pass out of the speaker into the adjacent air space.

Figure 4:
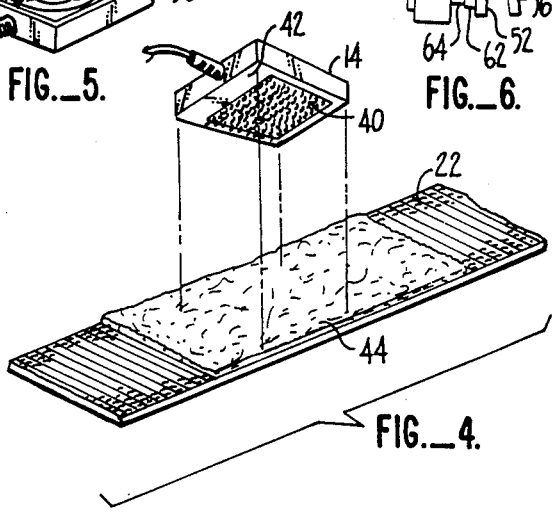
FIG. 4 is an enlarged, fragmentary, perspective view of the system, showing the way in which one of the stereo speakers is coupled to one of the straps of the suspenders.

Each speaker is removably coupled to a respective strap of the suspenders at a location on the strap near the upper portion of the shoulder of the user on which the suspenders are mounted. Any suitable reducible fastener can be used for this purpose, if desired. For purposes of illustration, a Velcro fastener is used as shown in FIG. 4 to connect each speaker with a corresponding strap.

To this end, a first Velcro part 40 is secured to the back surface 42 of the speaker housing. This part 40 mates with a second Velcro part 44 secured in any suitable manner, such as by stitching or by an adhesive, to the adjacent strap. Part 44 is relatively long so that the speaker position can be selectively adjusted, as desired, along the length of part 44. When the speakers are coupled to the straps 22 and 24 in the manner shown in FIG. 1 or FIG. 2, cables 20 loosely droop in a manner shown in FIG. 1. Thus, they do not interfere with the movements of the arms of the user and do not cause any undue pull on the speakers in a manner tending to pull them off the straps.

In use, system 10 is placed on the user in a manner such that the suspenders 12 can be worn with pouch 18 in the front of the user as shown in FIG. 1 or at the rear of the user as shown in FIG. 2. Then, the suspenders are coupled to the trousers or garment 28, and the radio 34 is placed in the pouch 18 while the speakers 14 and 16 are removably placed in coupled relationship to respective straps 22 and 24. Cables 20 are then coupled in the normal fashion to radio 34 and the radio is then operated in the usual manner. When so operated, stereo sounds issue from the speakers 14 and 16, and the sounds rise and are heard by respective ears of the wearer by virtue of the orientation of the speakers near the upper portions of the shoulders of the user. In this way, the user is able to enjoy the sound and has control of the volume by mere manipulation of the volume control on radio 34 in the normal fashion.

Figure 6:
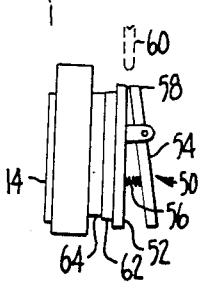
FIG. 6 is a side elevational view of a clip for attaching a speaker to an article of clothering.

Another way to couple each of speakers 14 and 16, respectively, to a garment is by the use of a clip 50 of the type shown in FIG. 6. Clip 50 has a base 52 on which is pivotally mounted a clip member 54 which is biased by a spring 56 into a position such that the end 58 of member 54 is normally forced toward base 56. Thus, a garment article 60, such as the projecting portion of a collar of a shirt, can be placed between end 50 and base 52 and the clip 50 will be releasably held on the collar 60.

A Velcro layer 62 will be on the opposite side of base 52 for engagement with a Velcro layer 64 on the back of a speaker, such as speaker 14. Thus, by using two clips 50, both speakers can be releasably coupled to an existing garment, such as at the collar portions of a shirt so that stereo sounds may issue from the speakers and such sounds can be heard by the ears of the wearer by virtue of the orientation of the speakers near the upper portions of the shoulders of the user.

System 10 provides a means for enjoying stereo sounds without the need for earphones as is conventionally required with a Walkman-type radio. The system allows the radio to be easily worn on the suspenders or on a belt at the waist of the user of the system, whichever is desired. The system is readily adjustable for persons of different sizes, assuming that the suspenders 12 can be adjusted as is conventionally known. Thus, the user of system 10 can enjoy stereo sounds, such as stereo music, emanating from the speakers when the user is sitting, walking, running or otherwise moving about.

We claim:

1. A stereo speaker system for a radio and or cassette/player device comprising:

a pair of suspenders comprising a pair of straps adapted to extend over the shoulders of a user, said straps having shoulder portions, each strap having a pair of ends, each end of each strap having a fastener means for release coupling to a garment worn by the user;

a pair of stereo speakers, each speaker having an electrical lead coupled thereto and adapted to be coupled to the device; and quick release attaching means removably mounting the speakers on respective shoulder portions, said straps crossing each other at a crossover location, there being a pouch attached to the straps at said location for holding said device.

* * * * *